US007734244B2

(12) United States Patent
Yu et al.

(10) Patent No.: US 7,734,244 B2
(45) Date of Patent: Jun. 8, 2010

(54) APPARATUS FOR CONDITIONING A SUBSTRATE

(75) Inventors: Robert C. U. Yu, Webster, NY (US); Jimmy E. Kelly, Rochester, NY (US); Stephen T. Avery, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 419 days.

(21) Appl. No.: 11/678,220

(22) Filed: Feb. 23, 2007

(65) Prior Publication Data

US 2008/0202369 A1 Aug. 28, 2008

(51) Int. Cl.
*G03G 15/00* (2006.01)

(52) U.S. Cl. ..... 399/390; 399/388

(58) Field of Classification Search ..... 399/390, 399/388

See application file for complete search history.

(56) References Cited

U.S. PATENT DOCUMENTS

| | | | | |
|---|---|---|---|---|
| 3,121,006 | A | 2/1964 | Middleton et al. | |
| 4,286,033 | A | 8/1981 | Neyhart et al. | |
| 4,291,110 | A | 9/1981 | Lee | |
| 4,338,387 | A | 7/1982 | Hewitt | |
| 4,440,486 | A * | 4/1984 | Isaka et al. | 399/339 |
| 4,464,450 | A | 8/1984 | Teuscher | |
| 4,587,189 | A | 5/1986 | Hor et al. | |
| 4,664,995 | A | 5/1987 | Horgan et al. | |
| 4,921,773 | A | 5/1990 | Melnyk et al. | |
| 5,136,334 | A * | 8/1992 | Camis et al. | 399/233 |
| 5,412,459 | A * | 5/1995 | Borsuk et al. | 399/296 |
| 5,621,512 | A * | 4/1997 | Uehara et al. | 399/328 |
| 5,689,785 | A * | 11/1997 | Kato et al. | 399/302 |
| 5,887,236 | A * | 3/1999 | Hirao et al. | 399/330 |
| 6,226,488 | B1 * | 5/2001 | Maeyama | 399/322 |
| 7,283,760 | B2 * | 10/2007 | Condello et al. | 399/45 |
| 7,383,011 | B2 * | 6/2008 | Omata | 399/329 |
| 2004/0175208 | A1 * | 9/2004 | Ichida et al. | 399/302 |

* cited by examiner

*Primary Examiner*—Anthony H. Nguyen
(74) *Attorney, Agent, or Firm*—Oliff & Berridge, PLC

(57) ABSTRACT

An image development method implemented on a substrate conditioning unit for the drying and compression of a print substrate in an electrophotographic imaging process. The conditioning unit includes a heating mechanism for maintaining the heat of compression rollers, belts or nip rollers for compressing the substrate by a determined distance between the conditioning rollers, or by direct contact between a compression roller and a nip roller, and having an abhesive layer to prevent adhesion of the conditioning unit to the print substrate.

22 Claims, 1 Drawing Sheet

APPARATUS FOR CONDITIONING A SUBSTRATE

TECHNICAL FIELD

The present disclosure relates to a device in the field of electrophotography. Specifically, it relates to a xerographic imaging pre-treatment and conditioning unit to provide the dual functions of reducing moisture from a print receiving substrate, such as by heat conditioning, and reducing filler and fine particle release from the print receiving substrate, such as by compacting filler particles inside the print receiving substrate matrix, to minimize the effects of causing the electrophotographic imaging member mechanical damage and copy print-out image degradation during the xerographic imaging process.

BACKGROUND

The electrophotographic imaging process is well known. In electrophotography, also known as Xerography, electrophotographic imaging members, such as photoreceptors or photoconductors, have photoconductive surface layers formed on an electricaly conductive substrate or formed on layers between the substrate and photoconductive layer. The photoconductive layer is the top outermost exposed layer and functions as an insulator so that during machine imaging processes, electric charges are retained on its surface.

Electrophotographic imaging members are typically in a rigid drum configuration and/or a flexible belt form. For flexible imaging member belts, they may either be seamed or seamless belts; however, for reasons of simplicity, the disclosures hereinafter will focus only on electrophotographic imaging members in flexible belt form.

Furthermore, the photoconductive insulating layer on the conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print receiving substrate, such as paper or transparency. The imaging process may be repeated many times with reusable imaging members.

Xerographic image forming devices have become necessary productivity tools for producing and reproducing documents. Such image forming devices include, but are not limited to, desktop copiers, stand-alone copiers, scanners, facsimile machines, photographic copiers and developers, and multi-function devices and other like systems capable of producing and reproducing image data from an original document, data file or the like.

In typical negatively-charged electrophotographic imaging members, the top outermost exposed photoconductive layer is a charge transport layer. Under normal machine operating conditions, the surface of the transport layer is repeatedly subjected to physical contact from various mechanical subparts, including the cleaning brush, the cleaning blade, the tap bade and image receiving papers. This contact has been found to causes abrasion, scratching and general wear on the photoconductive layer. In particular, loose filler particles, such as crystalline $CaCO_3$, deposited in the image receiving papers are the main source of the early onset of imaging member surface scratching damage. As a result of surface scratching on the transport layer, defects in copy printouts and shortened imaging member function life present a serious problem.

Moreover, the moisture content in the receiving papers has also been determined to be a major contributing factor to deletion defects in copy printouts. Moisture in the material matrix of the receiving paper degrades and impedes toner-imaging capability by reducing the efficiency of toner transfer from the imaging member surface to the substrate. Within the realm of toner degradation, toner "deletion" refers to imperfect formation of toner images onto a print receiving substrate during the toner transfer process. Notably, it has been found that increasingly humid environmental conditions pronounce the effect of deletion development.

Under normal xerographic imaging conditions, toner image print deletion and imaging member surface degradation are two major factors in limiting, copy image quality and imaging member life in image forming devices. As discussed, the loose filler particles and the moisture content in the receiving papers present serious problems in Xerography. Therefore, it is apparent that substantial advancement by way of extending the imaging member service life and suppressing deletion in the printout copy could be achieved by the conditioning unit described in the embodiments of the present disclosure.

SUMMARY

The present disclosure addresses this and other problems by developing a commercially viable solution to the mentioned inefficiencies by providing an electrophotographic imaging apparatus, comprising an image forming unit for developing and transferring an image to a print substrate and a substrate conditioning unit comprising at least two rollers, situated before the image forming apparatus in a print substrate transport direction, wherein at least one roller heats or compresses, or heats and compresses, the print substrate. An aspect of this apparatus is a thermodynamic mechanism for controlling the temperature of at least one of the rollers within the range of about 100° C. to about 200° C. Another aspect of this is a distance between at least two of the rollers for conditioning the print receiving substrate of about 30% to about 90% of a thickness of the print receiving substrate. Another aspect of this apparatus is at least one roller that includes an overcoat layer comprising a low surface energy abhesive layer or a heat-resistant layer, or low surface energy and heat-resistant abhesive layer.

The disclosure also provides for an image development method, comprising transporting a print receiving substrate to a substrate conditioning unit comprising at least two rollers, where at least one roller heats or compresses, or heats and compresses, the print substrate, conditioning the print substrate by heat drying and compressing the print substrate before transferring a toner image onto the print substrate, developing a toner image on an imaging member, transferring the developed toner image to the print substrate, and fixing/fusing the toner image to the print substrate. An aspect of this method is conditioning the substrate where at least one of the rollers maintains a temperature of from about 100° C. to about 200° C. and dries the print substrate by surface contact. Another aspect of this method is conditioning the substrate where at least one of the rollers compresses the print substrate from about 70% to about 10% of the print receiving substrate thickness and compacts loose particles by surface compression.

The results of this xerographic apparatus comprising the conditioning unit and method are effective for moisture removal and compaction of loose filler particles that substantially minimizes toner image print deletion and the imaging member damage. Furthermore, the implementation of this unit and method can also yield the significant added benefit of enhancing rigidity and beam strength of the substrate.

The term "abhesive" as it is used in this disclosure refers to the property of non-adhesiveness. Thus, if something is abhesive, it is not sticky and generally has a good surface releasing property.

In embodiments, the disclosure provides a means and methodology for providing xerographic machines with a substrate conditioning unit that implements an image development method that conditions a print substrate in an electrophotographic imaging process with at least two rollers, in which at least one roller heats or compresses, or heats and compresses, the print substrate before transferring a formed toner image from the imaging member surface to the print substrate In other embodiments, the disclosure provides an apparatus for providing xerographic machines with a substrate conditioning unit that implements an image development method that conditions a print substrate in an electrophotographic imaging process with at least two rollers, in which at least one roller heats or compresses, or heats and compresses, the print substrate before transferring a toner image to the print substrate and includes an overcoat layer comprising an abhesive layer or a heat-resistant layer, or a low surface energy and heat-resistant abhesive layer.

In other embodiments, the disclosure provides an image development method that conditions a print substrate in an electrophotographic imaging process with at least two rollers, in which at least one roller heats or compresses, or heats and compresses, the print substrate before transferring a developed toner image on the imaging member surface over to the print substrate.

Therefore, it is an object of this disclosure to provide an improved electrophotographic imaging system having the dual benefit of compacting loose filler particles and eliminating moisture content by effectively reducing imaging member surface damage and copy deletion defects.

EMBODIMENTS

Figure 1:
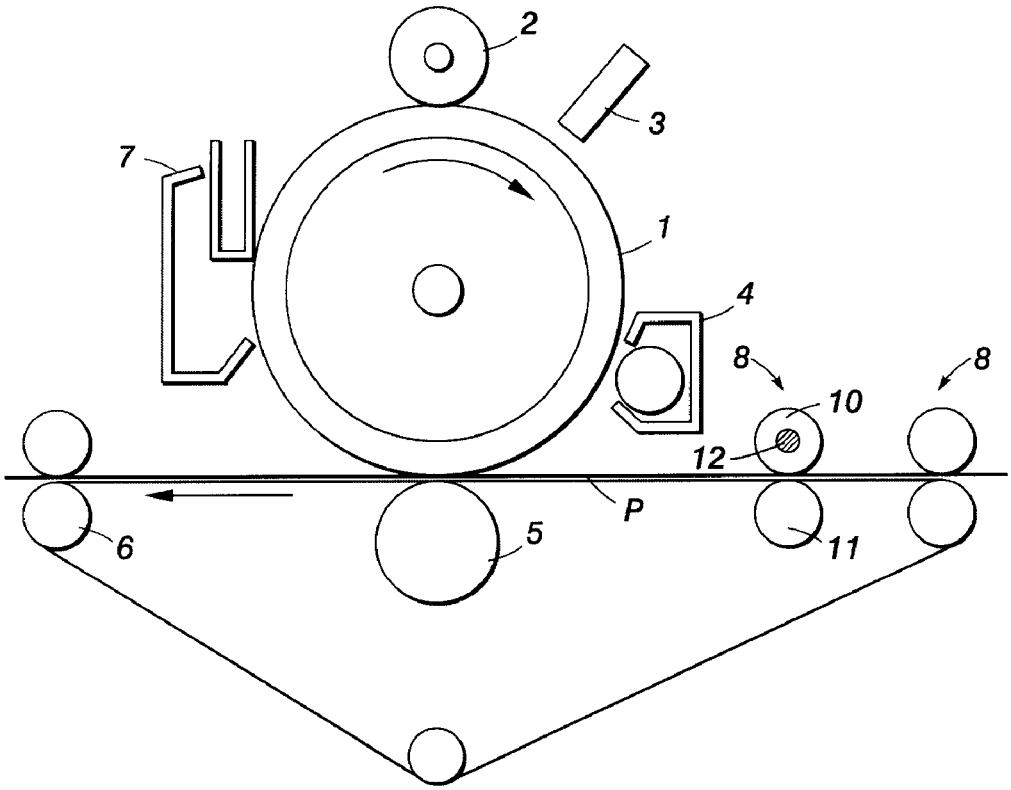
FIG. 1 is a schematic view showing an embodiment of a general electrophotographic imaging apparatus comprising an image receiving substrate conditioning unit of the disclosure, a photoreceptor member, and related subsystems.

FIG. 1 is a schematic view showing an embodiment of an apparatus or xerographic machine. In the apparatus shown in the FIG. 1, an electrophotographic photoreceptor 1, consisting of a flexible photoreceptor member belt, is mounted over and encircles a support rigid drum rotatable at a specified rotational speed in the direction indicated by the arrow centered on the axis support 9. A charging device 2, an exposure device 3, a developing device 4, a transfer device 5 and a cleaning unit 7 are arranged in this order along the rotational direction of the electrophotographic photoreceptor 1. Further, this exemplary apparatus is equipped with an image fixing device 6, and a substrate medium P to which a toner image is to be transferred is conveyed to the image fixing device 6 through the transfer device 5. More particularly, in embodiments, the disclosure generally provides for a substrate conditioning unit 8 comprising rollers 10 and 11 maintained in a temperature-controlled state by a heating mechanism 12. The rollers are variably adjusted such that there is a distance between the surface of each roller to account for the thickness of the substrate and some degree of compaction. The surfaces of each roller can be coated over with a selected material for enhancement of any one or more of several factors, including non-adhesion and heat-resistance characteristics. The conditioning unit and method generally provide a compacted, smooth, and dry substrate ideal for toner imaged transfer and avoiding surface damage of the photoreceptor member.

In a typical electrophotographic reproducing apparatus, shown in FIG. 1, an original image to be copied is recorded in the form of an electrostatic latent image upon a photoreceptor member and the latent image is subsequently rendered visible by the application of electroscopic thermoplastic resin particles, which are commonly referred to as toner. Specifically, photoreceptor member belt 1 encircling the rigid drum support is being charged on its surface by means of an electrical charger 2, to which a voltage has been supplied from a power supply (not shown in FIG. 1). The photoreceptor is then image-wise exposed to light from an optical system or an image input apparatus 3, such as a laser and light emitting diode, to form an electrostatic latent image thereon. Generally, the electrostatic latent image is developed by bringing a developer mixture from developer station 4 into contact therewith. Development can be effected by use of a magnetic brush, powder cloud, or other known development process.

After the toner particles have been deposited on the photoconductive surface of photoreceptor member belt 1, in image configuration, they are transferred to an image receiving substrate P, by transfer means 5, which can be pressure transfer or electrostatic transfer. After the transfer of the developed image is completed, receiving substrate P advances to fusing station 6, depicted in FIG. 1 as fusing and pressure rolls, wherein the developed image is fused/fixed onto image receiving substrate P to thereby form a permanent image. Photoreceptor 1, subsequent to transfer, advances to cleaning station 7, wherein any toner left on the surface of photoreceptor 1 is cleaned therefrom by use of a blade, brush (not shown), or other cleaning means.

However, in other electrophotographic imaging systems, photoreceptor 1 supported around the rigid drum (as that shown in the electrophotographic imaging apparatus of FIG. 1) is a flexible belt mounted over and around a belt support module utilizing numbers of supporting rollers of varying diameters such that the photoreceptor belt is constantly subjected to cyclic belt motion as the belt rotates/revolve over and around each of the support rollers during dynamic fatigue machine belt imaging process.

Figure 2:
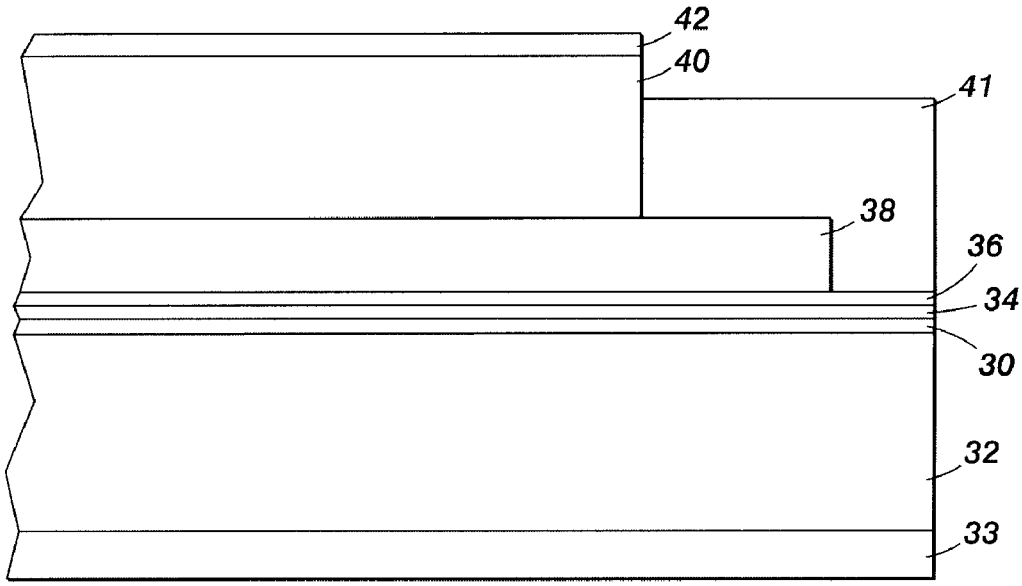
FIG. 2 is an illustration of an embodiment of a typical negatively charged photoreceptor member employed in the electrophotographic imaging apparatus shown in FIG. 1 with various layers.

A negatively charged, multilayered electrophotographic imaging member of flexible web stock configuration is illustrated in FIG. 2. Generally, such a member includes a substrate support layer 32 on which a conductive layer 30, a hole-blocking layer 34, a charge generating layer 38, and an active charge transport layer 40 are formed. An optional adhesive layer 36 can be applied to the hole-blocking layer 34 before the photogenerating layer 38 is deposited. Other layers, such as a grounding strip layer 41 or an overcoat layer 42 can be applied to provide various characteristics, such as improve resistance to abrasion. On the opposite surface of substrate support 32, an anticurl backing layer 33 can be applied to reduce the curling induced by the different coefficients of thermal expansion of the various layers of the belt.

The thickness of the substrate support 32 can depend on factors including mechanical strength, flexibility, and economical considerations, and can have, for example, a thickness of between about 25 μm and 200 μm. However, a thickness in the range of from about 50 μm to about 125 μm gives better light transmission and substrate support layer flexibility. A typical thickness of about 76 μm is generally accepted for use, since it presents best physical and mechanical effects on the prepared electrophotographic imaging member device. The substrate support 32 should not be soluble in any of the solvents used in each coating layer solution, optically clear, and able to thermally resist high temperatures, such as 150° C. A typical substrate support 32 used for conventional imaging member fabrication has a thermal contraction coefficient ranging from about 1×10−5/° C. to about 3×10−5/° C. and with a Young's Modulus of between about 5×105 psi and about 7×105 psi. However, materials with other characteristics can be used as appropriate.

The conductive layer 30 can vary in thickness over substantially wide ranges depending on the optical transparency and flexibility desired for the electrophotographic imaging member. Accordingly, when a flexible electrophotographic imaging belt is desired, the thickness of the conducive layer can be between about 20 Å and about 750 Å, and more preferably between about 50 Å and about 200 Å for an optimum combination of electrical conductivity, flexibility and light transmission. The conductive layer 30 can be an electrically conductive metal layer formed, for example, on the substrate by any suitable coating technique. Alternatively, the entire substrate can be an electrically conductive metal, the outer surface thereof performing the function of an electrically conductive layer and a separate electrical conductive layer may be omitted.

After formation of an electrically conductive surface, the hole-blocking layer 34 can be applied thereto. The blocking layer 34 can comprise nitrogen containing siloxanes or nitrogen containing titanium compounds as disclosed, for example, in U.S. Pat. Nos. 4,291,110; 4,338,387; 4,286,033; and, 4,291,110, the disclosures of these patents being incorporated herein in their entirety.

An optional adhesive layer 36 can be applied to the hole-blocking layer. Any suitable adhesive layer may be utilized, such as a linear saturated copolyester reaction product of four diacids and ethylene glycol or a polyarylate. Any adhesive layer employed should be continuous and, preferably, have a dry thickness between about 200 μm and about 900 μm and, more preferably, between about 400 μm and about 700 μm. Any suitable solvent or solvent mixtures can be employed to form a coating solution of polyester. Any other suitable and conventional technique ray be utilized to mix and thereafter apply the adhesive layer coating mixture of this invention to the charge-blocking layer.

Any suitable charge generating layer 38 can be applied to the blocking layer 34 or adhesive layer 36, if such an adhesive layer 36 is employed, which can thereafter be overcoated with a contiguous charge transport layer 40. Appropriate photogenerating layer materials are known in the art, such as benzimidazole perylene compositions described, for example in U.S. Pat. No. 4,587,189, the entire disclosure thereof being incorporated herein by reference. More than one composition can be employed where a photoconductive layer enhances or reduces the properties of the charge-generating layer. Other suitable photogenerating materials known in the art can also be used, if desired. Any suitable charge generating binder layer comprising photoconductive particles dispersed in a film forming binder can be used. Additionally, any suitable inactive resin materials can be employed in the photogenerating binder layer including those described, for example, in U.S. Pat. No. 3,121,006, the entire disclosure thereof being incorporated herein by reference.

The charge generating layer 38 containing photoconductive compositions and/or pigments and the resinous binder material generally ranges in thickness of from about 0.1 μm to about 5 μm, is preferably to have a thickness of from about 0.3 micrometer to about 3 μm. The charge generating layer thickness is related to binder content. Higher binder content compositions generally require thicker layers for charge or photogeneration. Thicknesses outside these ranges can be selected providing the objectives of the present disclosure are achieved.

The active charge transport layer 40 can comprise any suitable activating compound useful as an additive dispersed in electrically inactive polymeric materials making these materials electrically active. These compounds may be added to polymeric materials, which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. Thus, the active charge transport layer 40 can comprise any suitable transparent organic polymer or non-polymeric material capable of supporting the injection of photogenerated holes and electrons from the binder layer and allowing the transport of these holes or electrons through the organic layer to selectively discharge the surface charge.

The active charge transport layer 40 not only serves to transport holes, but also protects the photoconductive layer 38 from abrasion or chemical attack and therefore extends the operating life of the photoreceptor imaging member. The charge transport layer 40 should exhibit negligible, if any, discharge when exposed to a wavelength of light useful in xerography, for example, 4000 Å to 9000 Å. Therefore, the charge transport layer is substantially transparent to radiation in a region in which the photoconductor is to be used. Thus, the active charge transport layer is a substantially non-photoconductive material, which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the charge generation layer in the instant invention is a material, which is an insulator to the extent that an electrostatic charge placed on the transport layer is not conducted in the absence of illumination.

The charge transport layer 40 forming mixture preferably comprises an aromatic amine compound. For example, suitable charge transport compounds that can be selected for the charge transport layer include aryl amines of the following formula

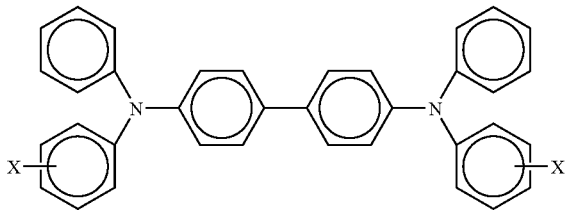

and wherein the thickness thereof is, for example, from about 5 microns to about 75 microns, or from about 10 microns to about 40 microns dispersed in a polymer binder, wherein X is an alkyl group, a halogen, or mixtures thereof, especially those substituents selected from the group consisting of CI and $CH_3$.

Examples of specific aryl amines are N,N'-diphenyl-N,N'-bis(alkylphenyl)-1,1'-biphenyl-4,4'-diamine wherein alkyl is selected from the group consisting of methyl, ethyl, propyl, butyl, hexyl, and the like; and N,N'-diphenyl-N,N'-bis (halophenyl)-1,1'-biphenyl-4,4'-diamine wherein the halo substituent is preferably a chloro substituent. Other known charge transport layer molecules can be selected, reference, for example, U.S. Pat. Nos. 4,921,773 and 4,464,450, the entire disclosures of which are incorporated herein by reference.

In the charge transport layer, the charge transport agent(s) are molecularly dispersed, or may be dissolved, in an electrically insulating organic polymeric film forming binder. In general, any of the polymeric binders useful in the photoconductor element art can be used, including, for example, the unmodified binders described above for use in a charge generation layer. Examples of suitable binder materials selected for the transport layers include components, such as those described in U.S. Pat. No. 3,121,006, the disclosure of which is totally incorporated herein by reference. Specific examples of polymer binder materials include polycarbonates, polystyrene, acrylate polymers, vinyl polymers, cellulose polymers, polyesters, polysiloxanes, polyamides, polyurethanes and epoxies, and block, random or alternating copolymers thereof. A specific electrically inactive binder is comprised of polycarbonate resins having molecular weight of from about 20,000 to about 100,000, and in some embodiments, a molecular weight of from about 50,000 to about 200,000. However, polycarbonate and polystyrene are generally the preferred thermoplastic binder of choice for charge transport layer formulation to give best mechanical and electro-photographic imaging results. The preferably thermoplastic polycarbonate binder of interest is being either a poly(4,4'-isopropylidene diphenyl carbonate) or a poly(4,4'-diphenyl-1,1'-cyclohexane carbonate).

Typically, charge transport layers employed in one of the two electrically operative layers in the multi-layer imaging member web stock is comprised of from about 35 weight percent to about 45 weight percent of at least one charge transporting aromatic amine compound, and about 65 weight percent to about 55 weight percent by weight of a polymeric film forming resin in which the aromatic amine is soluble. The substituents should be free form electron withdrawing groups such as $NO_2$ groups, CN groups, and the like, and are typically dispersed in an inactive resin binder.

However, in the present disclosure, in order to provide a resulting imaging member with maximum photo-electrical performance enhancement, the charge transport layer 40 employed in the multi-layer imaging member web stock comprises from about 55 weight percent to about 70 weight percent of charge transport compound, such as a transporting aromatic amine compound, and about 45 weight percent to about 30 weight percent of a polymeric film forming resin. Optionally, the charge transport layer 40 comprises from about 55 weight percent to about 65 weight percent of a charge transport compound and from about 45 weight percent to about 35 weight percent of a polymeric film forming resin. The increased amounts of the charge transport compound in the charge transport layer provides effectual residual voltage reduction and/or improved photo discharge sensitivity.

In addition to a charge transport compound and a binder polymer, the charge transport layer may contain various optional additives, such as surfactants, levelers, plasticizers, and the like. On a 100 weight percent total solids basis, a charge transport layer can contain for example up to about 15 weight percent of such additives, although it may contain less than about 1 weight percent of such additives.

Coating of the charge transport layer composition over the charge generation layer can be accomplished using a solution coating technique such as knife coating, spray coating, spin coating, extrusion hopper coating, curtain coating, and the like. After coating, the wet charge transport layer composition is usually dried at elevated temperature of about 120° C.

The charge transport layer 40 should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2.1 to 200:1 and in some instances as great as 400:1. Generally, the thickness of the charge transport layer 40 is between about 5 μm and about 100 μm, but thickness outside this range can also be used provided that there are no adverse effects. Typically, it has a Young's Modulus in the range of from about 2.5×105 psi to about 4.5×105 psi and with a thermal contraction coefficient of between about 6×10−5/° C., and about 8×10−5/° C. Furthermore, the charge transport layer also typically has a glass transition temperature Tg of a range of between about 65° C. and about 100° C.

Other layers, such as conventional ground strip layer 41 comprising, for example, conductive particles dispersed in a film forming binder may be applied to one edge of the photoreceptor in contact with the conductive layer 30, hole-blocking layer, adhesive layer 36 or charge generating layer 38. The ground strip 41 can comprise any suitable film forming polymer binder and electrically conductive particles. Typical ground strip materials include those enumerated in U.S. Pat. No. 4,664,995. The ground strip layer 41 may have a thickness from about 7 μm to about 42 μm, and preferably from about 14 μm to about 23 μm. Optionally, an overcoat layer 42, if desired, can also be utilized to improve resistance and provide protection to imaging member surface abrasion.

Since the charge transport layer 40 typically exhibits a great thermal contraction mismatch compared to that of the substrate support 32, the prepared flexible electrophotographic imaging member exhibits spontaneous upward curling due to the result of larger dimensional contraction in the charge transport layer than the substrate support, especially as the imaging member cools down to room ambient after the heating/drying processes of the applied wet charge transport layer coating . An anti-curl back coating 33 can be applied to the backside of the substrate support 32 (which is the side opposite the side bearing the electrically active coating layers) to render imaging, member flatness. The anti-curl back coating 33 can comprise any suitable organic or inorganic film forming polymers that are electrically insulating or slightly semi-conductive.

The anti-curl back coating 33 should have a thermal contraction coefficient of at least about 1×10−5/° C. greater than that of the substrate support to be considered satisfactory. Typically, a substrate support has a thermal contraction coefficient of about 2×10−5/° C. However, anti-curl back coating with a thermal contraction coefficient at least +2×10−5/° C. larger than that of the substrate support is preferred to produce an effective anti-curling result. The selection of a thermoplastic film forming polymer for the anti-curl back coating application has to be satisfying all the physical, mechanical, optical, and importantly, the thermal requirements above. Polymer materials that meet these disclosure requirements include a variety of polymers known in the art. These polymers can be block, random or alternating copolymers. Furthermore, the selected film forming thermoplastic polymer for anti-curl back coating 33 application, if desired, can be of the same binder polymer used in the charge transport layer 40.

In addition, the electrophotographic imaging member, if desired, may optionally include an overcoating layer 42 to provide abrasion protection.

The fabricated multilayered, flexible electrophotographic imaging member web stock of FIG. 2, having the desired flatness, is then cut into rectangular sheets and converted into imaging member belts. The two opposite edges of each imaging member cut sheet are then brought together by overlapping and may be joined by any suitable method, including ultrasonic welding, gluing, taping, stapling, and pressure and heat fusing to form a continuous imaging member seamed belt, sleeve, or cylinder. From the viewpoint of considerations such as ease of belt fabrication, short operation cycle time, and mechanical strength of the fabricated joint, the ultrasonic welding process is more advantageous. The prepared flexible imaging belt can therefore be employed in any suitable and conventional electrophotographic imaging process, such as for example shown in FIG. 1, that utilizes uniform charging prior to image-wise exposure to activating electromagnetic radiation.

According to FIG. 1, the substrate conditioning unit 8 of the present disclosure provides for at least two rollers, 10 and 11. In preferred embodiments, two rollers are used as this fits into the xerographic substrate feed cycle most effectively and presents an efficient mode of carrying out the substrate conditioning method. In other embodiments, a plurality of rollers, such as three, four, or more, can be used to effectuate diverse compression mechanics and accommodate technological changes. Thus, any suitable number of rollers can be used.

Further, although this disclosure refers to the use of two or more rollers, it will be appreciated that rollers can be replaced by other suitable structures, such as one or more rollers with an opposing fixed surface, endless belt(s), or the like. If the conditioning unit uses the endless belt(s), the conditioning unit comprises a compression/heating roller and a flexible belt having a hard backing roller positioned at the backside of the belt to provide support. The backing support roller may or may not be heated and the belt is supported by a bi-roller sustentation. Otherwise, the unit can also consist of two separated flexible belts each having a hard heated backing roller support. The flexible belt is comprised of a heat resistance thermoset or thermoplastic polymer having a glass transition temperature (Tg) of at least 120° C., such as for example, polyimide, polycarbonate, polyarylate, polysulfone, polyether sulfone, polyether ether ketone, biaxially oriented polyethylene terepthalate, biaxially polyethelene naphthalate, and the like. For good flexibility, heat transfer efficiency, and tension stability, the thickness of the belt is from about 1 to about 7 mils, but preferably from about 2 and about 5 mils. Furthermore, the flexible belt may also contain an inorganic or organic particulate dispersion or a liquid lubricant, same as that used in the roller, in its material matrix.

However, the conditioning units of present disclosure designed to comprise two rollers are desirable in embodiments, as they allow for easier print substrate transport and easier accommodation of the desired application of temperature and pressure, and they fit better in the xerographic imaging machine. Although both rollers may or may not have the same diameter, nonetheless it is preferably to be identical; the diameter is from about 0.5 to about 3.0 inches. A diameter of from about 1.0 and about 2.0 inches gives the best results.

To effectuate heating and compression, a configuration of the rollers in the substrate conditioning unit is determined. In preferred embodiments, the rollers are longitudinally stacked along the same vertical plane, as seen in the FIG. 1, to maximize structural assimilation of the device into an imaging device. However, in other embodiments, the rollers can be stacked horizontally or diagonally along the same plane. In still other embodiments, rollers can be situated at any suitable angle, and in appreciation of a plurality of rollers, any suitable configuration or ordering on the same or multiple angles or planes according to the specifications of the imaging device and the heat-compression device therein.

To achieve best results, the rollers are generally composed of a smooth, hard, heat-resistance material. In preferred embodiments, stainless steel is used for its proven quality as an effective component under xerographic conditions. However, any suitable material that is a hard and can readily conduct heat can be used in the roller design. In other embodiments, for example, metals, metal alloys and ceramics can be used. For the roller or rollers that is used for applying heat to the print substrate, the roller is also desirably made of a material that readily and quickly conducts heat. This allows for efficient delivery and transfer of heat from the roller to the print substrate to eliminate moisture and allow for faster heat conduction to warm-up the roller to an operating temperature.

In embodiments, to suppress and minimize roller-substrate adhesion, a protective overcoat layer having reduced surface adhesiveness as well as heat resistance can be provided to effect quick substrate release. As for heat-resistance, an overcoat layer can be provided; the overcoat is comprised of heat resistance polymer having a glass transition temperature (Tg) of at least 120° C., such as for example, polyester, polyimide, polycarbonate, polyarylate, polysulfone, polyether sulfone, polyether ether ketone, and the like. The overcoat is either applied by solution coating onto or laminated over each of he hard treatment rollers. Otherwise, the overcoat may be a thermoplastic flexible biaxially oriented polyethylene terepthalate belt, a flexible biaxially polyethelene naphthalate belt, or a flexible KAPTON™ (a polyimide film available from E. I. Du Pont de Nemours and Company) belt mounted over and encircled each roller.

To render these heat resistance overcoats with effectual surface abhesiness, embodiments include overcoat layers that comprise a polymer matrix in which a particulate organic or inorganic lubricant filler is dispersed. Organic particulates of interest, such as fluoropolymers, waxy polyethylene, Erucamide™, Oleamide™, Stearamide™, Kevlar aramide™, mixtures thereof, and the like, are uniformly dispersed. Suitable particulate inorganic include boron nitride, graphite, molybdenum sulfide, stannous stearate, zinc stearate, and mixtures thereof.

In alternative embodiments, a liquid lubricant utilized to provide the heat resistance overcoat with surface abhesivness for quick print substrate release is selected from, for example silicone fluid, polysiloxane slip agent, oligomeric PTFE, perfluoro polyether, alkoxylated fatty amine, and the like, or a mixture thereof. Both solid particulates and liquid lubricants used to achieve the intended result not only should have heat stability without chemical degradation at the elevated operating temperature specified for the conditioning unit, but are also chemically inert to reduce the likelihood of chemical reaction to complicate and affect the delicate photoelectrical function under a normal electrophotographic imaging service environment, including exposure to corona effluents from the charging device and interaction with other chemical contaminants.

As particulate fluoropolymers, any known particulate fluoropolymers having lubricant properties may be employed. Suitable particulate fluoropolymers include poly(tetrafluoroethylene) (PTFE), poly(vinylidene fluoride), poly(vinylidene fluoride co-hexafluoropropylene), fluorinated polyethylene, and mixtures thereof.

In embodiments, the particulate inorganic lubricant may be present in the overcoat layer as a plurality of particles ranging in size of from about 0.01 to about 5 μm. Similarly, particulate fluoropolymer of embodiments may be present in the overcoat layer as a plurality of particles ranging in size of from about 0.05 to about 0.5 μm. For example, the particulate inorganic lubricant may be a plurality of boron nitride particles ranging in size of from about 0.01 to about 5 μm and/or the particulate fluoropolymer may be a plurality of poly(tetrafluoroethylene) particles ranging in size of from about 0.01 to about 5 μm.

The particulate inorganic lubricant and particulate fluoropolymer in the overcoat layer of embodiments may be present in any suitable amounts. However, in particular embodiments, the particulate inorganic lubricant may be present in amounts from about 1 to about 20% by weight, relative to a total weight of the overcoat layer, and/or the particulate fluoropolymer may be present in amounts from about 5 to about 10% by weight, relative to a total weight of the overcoat layer.

The particulate inorganic lubricant and particulate fluoropolymer may be used individually or as composites or mixtures of particulate inorganic lubricants and particulate fluoropolymers. Such composites and mixtures are commercially available and include, for example, a commercially available line of particulate boron nitride and polytetrafluoroethylene (PTFE) from Acheson Colloidal Company, in which boron nitride, PTFE and mixtures thereof are available as dispersions in organic solvents of either alcohol or hydrocarbon. However, both inorganic and organic particulates are also commercially available as dry powder readily for coating solution dispersion. Particle size suitable for the present disclosure ranges from about 0.1 to about 5 μm.

In embodiments, the surface of the substrate conditioning rollers may comprise a heat resistance and intrinsically abhesive elastomeric overcoat layer, having a Shore A hardness value of about 60 to about 90, to provide a slight nipping effect for heating and compressing the substrate. With the elasticity, the elastomeric overcoat will yield intimate surface contact with the print substrate to compress/compact loose filler particles and eliminate moisture as well. Elastomeric materials employed for overcoating the conditioning rollers, without the need of a solid or liquid lubricant, comprise an inherently low surface energy polymer, such as silicone rubber or fluoroelastomers as a material, in embodiments. For example, conventional materials known in the art for yielding desired results include silicone rubbers of polysiloxanes, and fluorocarbon elastomers such as, fluoroelastomers consisting of copolymers, terpolymers or tetrapolymers formed from any or all of vinylidenefluoride, hexafluoropropylene and tetrafluoroethylene, which are available under the trademark VITON™ from E. I. du Pont de Nemours & Co., polyvinyl fluoride such as available under the tradename TEDLAR™ also available from E. I. du Pont de Nemours & Co, various fluoropolymers such as polytetrafluoroethylene (PTFE), perfluoroalkoxy (PFA-TEFLON™), fluorinated ethylenepropylene copolymer (FEP), other TEFLON™-like materials, and the like and mixtures thereof.

Typical overcoat layer applied onto the heat/compression rollers is between about 10 and 200 μm. In other embodiments, the thickness is from about 20 to about 100 μm.

The substrate conditioning unit also includes a thermodynamic heating mechanism for controlling temperature as well as quick delivery of thermal energy to the print substrate to facilitate evaporation of moisture from a substrate. In preferred embodiments, the heating mechanism is an internal heating device or external heating device capable of controlling and maintaining preset temperature of the rollers. Any suitable means of heating for controlling and maintaining temperature of the rollers can be used.

The heating mechanism generates heat and maintains heat to effectuate a temperature commensurate with the quick evaporation of moisture in a substrate. In embodiments, any substrate of varied thickness for the collection and solidification of toner particles can be used. However, in embodiments, standard copy paper with a thickness in the range of about 0.0010 to about 0.0090 inches, such as about 0.0020 to about 0.0040 inches is used.

The heating mechanism operates to generate and maintain heat in range appropriate for the evaporation of moisture in the substrate. In particular embodiments, a heating range from about 100° C. to about 200° C. is realized. In embodiments, the rollers are maintained in a heating range from about 120° C. to about 180° C. or from about 120° C. to about 160° C. Any suitable heating range is acceptable provided it conforms to the specification of a print substrate chosen for image receiving copy. The heating mechanism can also operate to pre-heat or heat concurrently with the ruining of job according to requirements. In embodiments, the rollers are pre-heated to ensure uniform application of the evaporation procedure. However, any suitable heating application can be used.

Similarly, photoreceptor cleaning processes are well known in the art. In embodiments, the substrate conditioning unit, if needed, can be equipped with the cleaning unit similar to cleaning unit 7 for the photoreceptor device to remove excess filler particles, debris, contaminants and the like from the surface of the substrate conditioning rollers. Any suitable cleaning method can be used.

There is a distance between at least two rollers of the substrate conditioning unit that condition the print substrate (not shown in FIG. 1). In embodiments, the distance between the rollers is in the range of about 30% to about 90% of the thickness of the print substrate to effectuate good heat conduction and compaction of loose filler particles without materially altering the structure of the substrate or degrading the structural or adhesive properties of the rollers. In embodiments, the distance between the rollers is in the range of about 50 to about 70% of the thickness of the substrate. In other embodiments any suitable distance between the rollers is acceptable.

Further, it will be apparent based on this disclosure that one or more of the rollers in the conditioning unit can be adjustable, so as to allow adjustment of the gap between the rollers to accommodate different print substrate materials. For example, the distance may be adjustable to allow a larger distance when thicker print substrates, such as card stock or the like, are used, or to provide a smaller distance when thinner print substrates, such as thinner paper, are used. The adjustment may be made manually by the user, such as through a control panel, or may be made automatically by the imaging device based upon user-selected or machine-detected paper type and/or thickness.

In embodiments, it is anticipated that compaction does not materially alter the structure of the substrate. For example, in embodiments, the distance is adjusted so that the substrate retains its material properties, such as the toner image transferring/receiving capability after compaction.

Likewise, it is anticipated that heating/compression does not materially alter the structure of the substrate. For example, in embodiments, the heating and compression process is adjusted so that the substrate not only retains its original material property and integrity, but also adds the benefit of increasing the beam rigidity of the print substrate.

Exposure contact of the surface of the substrate conditioning rollers to the substrate passing through the rollers is considered. In embodiments, the rollers rotate in a direction according to the specification of the particular imaging device to synchronize and meet the print substrate's transporting speed. Furthermore, the rollers also rotate at a rate commensurate with effective heating and compression and substrate composure. In another embodiments, the rollers may rotate in a direction opposite to the operational direction for purposes of apparatus and device transferability and substrate removal during the event of dysfunctional substrate feeds.

The substrate conditioning rollers of embodiments reduce moisture and compact loose filler particles without materially altering the mechanical integrity of the substrate or degrading the structural or adhesive properties of the rollers. However, it is anticipated in embodiments that the substrate conditioning process will enhance the xerographic imaging process in other ways. For example, this process noticeably improves the rigidity and beam strength of a print receiving substrate, such as paper. Furthermore, the compaction of other loose particles damaging to the photoreceptor and the heat treatment of other chemicals in the substrate are Included in embodiments.

It is also anticipated that the substrate conditioning unit be capable of applying either heat or compression in an independent capacity from either one or the other of heat or compression. In an embodiment, heat and compression are applied together. However, in other embodiments the roller gap can be adjusted to reduce or eliminate compression while still applying heat. In still other embodiments, of course, compression can be applied while reducing or eliminating the heat. Any suitable procedure is embodied according to the specifications of the imaging device, toner, substrate and job.

Referring again to FIG. 1, the location of the substrate conditioning unit in an embodiment of a xerographic apparatus is adjacent to and upstream from the image forming unit. Moreover, in embodiments, the substrate conditioning unit immediately precedes the photoreceptor in the xerographic process to allow the purest form of the substrate possible to enter the photoreceptor for toner imaging. However, the substrate conditioning unit can precede the photoreceptor by any number of suitable steps in the xerographic process according to the particular specification of the xerographic system and process.

The electrophotographic imaging apparatus is not limited to one substrate conditioning unit. In embodiments, a plurality of substrate conditioning units can be upstream, consecutively adjacent and upstream or disjointedly adjacent and upstream from the image forming unit. It is anticipated that a plurality of substrate conditioning units streamline and enhance the conditioning process by refining and reducing load.

In a further embodiment of the disclosure, the bi-roller print substrate conditioning unit described in the preceding may be modified to comprise a heating hard roller and an fully elastic nip roller assembled to have no distance between and pressing against each other. The material of the hard roller has the same composition variances described in detail above and may also comprise an abhesive overcoat layer. The elastic nip is made of an elastomeric polymer around a 0.5 inch metal shaft/axis and has a Shore A hardness of between about 60 and about 90. Although the nip roller may or may not have the same diameters as the hard roller, in preferred embodiments it is about the same. The nip roller is positioned to press against the hard roller and make a nip of between about 5 and about 10 mm in contact compression in the circumferential direction.

The following examples are illustrative of embodiments of the present invention, but are not limiting of the invention. It will be apparent that the invention can be used or practiced in the context of many different imaging processes with many suitably different overcoat and substrate components as well as many different mechanisms for achieving the heating and compressing of a substrate with rollers.

EXAMPLES

Example 1

An experimental study was conducted to investigate the effect of conditioning print receiving papers by heat/compression treatment on photoreceptor member surface damage and copy print deletion. In summary, the experiment for pretreating a stack of papers was conducted by passing XEROX 4200 papers, having approximately 0.003-inch in thickness, through a xerographic imaging machine operated under conditions where all electrophotographic image processing systems, except for the development system, were turned on. Under these conditions of no image development, the heat/compression treatment progressed with full fuser devise operational but no toner dispensing for image formation, the papers were permitted to be output from the machine. The fuser treated XEROX papers thus obtained from the machine output exhibited about 40% beam rigidity enhancement. The treated papers were to be used for further electrophotographic imaging print test to assess the beneficial impact of heat/compression treatment, if any, on these resulting print receiving papers.

Example 2

This study was carried out with the use of the same machine and followed the same electrophotographic imaging procedures as described in EXAMPLE 1, except that the development system was turned on to give toner image print-out on copies.

In this study, a fresh stack of XEROX 4200 papers that were stored under normal room conditions were subject to the full machine electrophotographic imaging/copying process. The copy print-out obtained was found to exhibit a substantial degree of image deletion effect. Moreover, after running 100,000 copies, significant onset of copy image defects was observed. Optical examination of the image member surface, under 100× magnification with a microscope, showed direct association of the imaging member surface scratches to the observed copy print out defects. Further FTIR analysis disclosed that surface scratches were mainly caused by loose $CaCO_3$ fillers from the print receiving papers.

Example 3

This study was carried out again with the use of the use of the same machine and followed the same electrophotographic imaging procedures as described in EXAMPLE 2, except that machine fuser treated papers of EXAMPLE 1 were used as the print substrate for image copying.

The print defects and deletion in printout copy observed in EXAMPLE 2 were not observed in this study even after 200,000 copies of print volume. This machine print test result had established that heat/compression pre-treatment of papers is the key to provide effectual resolution for eliminating the copy deletion and print defects problems.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic imaging apparatus, comprising:

an image forming unit for developing and transferring an image to a print substrate; and a substrate conditioning unit comprising at least two rollers for compressing the print substrate from about 70% to about 10% of the print substrate thickness, situated before the image forming unit in a print substrate transport direction, wherein the at least two rollers are configured to compress the print substrate;

at least one roller is configured to heat the print substrate; and a distance between at least two of the rollers conditioning the print substrate is about 30% to about 90% of a thickness of the print substrate.

2. The apparatus of claim 1, wherein the image forming unit comprises:

an electrophotographic imaging member;

a charging device;

an exposure device;

a developing device;

a toner transfer device; and a cleaning unit.

3. The apparatus of claim 1, wherein the substrate conditioning unit is situated immediately before the image forming unit in a print substrate transport direction.

4. The apparatus of claim 3, further comprising a thermodynamic mechanism for controlling a temperature of at least one of the rollers.

5. The apparatus of claim 4, wherein the temperature is maintained in a range of about 100° C. to about 200° C.

6. The apparatus of claim 1, wherein at least one of the rollers conditioning the print substrate is at least partially covered by a belt.

7. The apparatus of claim 1, wherein at least one of the rollers is an elastomer nip roller that comes into contact with the other roller and both rollers condition the print substrate.

8. The apparatus of claim 1, wherein at least one of the rollers is coated with a heat-resistant overcoat layer.

9. The apparatus of claim 8, wherein the heat-resistant overcoat layer comprises a polymer having a glass transition temperature (Tg) of at least 120° C.

10. The apparatus of claim 9, wherein the polymer is selected from the group consisting of polyester, polyimide, polycarbonate, polyarylate, polysulfone, polyether sulfone, and polyether ether ketone.

11. The apparatus of claim 10, wherein the heat resistant overcoat layer comprises dispersion particles of organic particulates of fluoropolymers, waxy polyethylene, and mixtures thereof, or inorganic particulate of boron nitride, graphite, molybdenum sulfide, stannous stearate, zinc stearate, and mixtures thereof.

12. The apparatus of claim 11, wherein the particulates of fluoropolymers are selected from the group consisting of poly(tetrafluoroethylene)(PTFE), poly(vinylidene fluoride), poly(vinylidene fluoride co-hexafluoropropylene), fluorinated polyethylene, and mixtures thereof.

13. The apparatus of claim 1, wherein at least one of the rollers is coated with an intrinsically abhesive and heat resistant overcoat layer.

14. The apparatus of claim 13, wherein the abhesive overcoat layer comprises an inherently low surface energy polymer of silicone rubbers of polysiloxanes, or fluorocarbon elastomers of fluoroelastomers consisting of copolymers, terpolymers or tetrapolymers of vinylidenefluoride, hexafluoropropylene and tetrafluoroethylene, polyvinyl fluoride, polytetrafluoroethylene (PTFE), perfluoroalkoxy, fluorinated ethylenepropylene copolymer (FEP), or a mixture thereof

15. The apparatus of claim 13, wherein the abhesive and heat resistant overcoat layer is from about 10 to about 200 micrometers in thickness.

16. The apparatus of claim 13, wherein the overcoat layer is a belt comprising at least one of:

a flexible biaxial polyethylene terepthalate belt, a flexible biaxial polyethelene naphthalate belt, and a flexible polyimide belt, wherein the belt is mounted over and at least partially covers the roller.

17. The apparatus of claim 13, wherein the abhesive overcoat layer is comprised of a liquid lubricant additive selected from the group consisting of a silicone fluid, polysiloxane slip agent, oligomeric PTFE, perfluoro polyether, alkoxylated fatty amine, and mixtures thereof incorporated within.

18. The apparatus of claim 13, wherein the abhesive overcoat layer is a polymer matrix, wherein particles selected from a group consisting of lubricants of an organic particulate of poly(tetrafluoroethylene) (PTFE), poly(vinylidene fluoride), poly(vinylidene fluoride co-hexafluoropropylene), fluorinated polyethylene, waxy polyethylene, Erucamide™, Oleamide™, Stearamide™, Kevlar™ aramide™, mixtures thereof, and the like, or an inorganic particulate of boron nitride, graphite, molybdenum sulfide, stannous stearate, zinc stearate, and mixtures thereof are uniformly dispersed.

19. the apparatus of claim 18, wherein the polymer matrix is an organic polymer layer consisting of a group selected from block, random, or alternating copolymer polymers having a glass transition temperature of at least 120° C.

20. An electrophotographic image development method, comprising:

transporting a print substrate to a substrate conditioning unit comprising at least two rollers, compressing the substrate from about 70% to about 10% of the print substrate thickness, wherein the at least two rollers are configured to compress the print substrate;

at least one roller is configured to heat the print substrate; and a distance between at least two of the rollers conditioning the print substrate is about 30% to about 90% of a thickness of the print substrate conditioning the print substrate by heat drying and compressing the print substrate before transferring a toner image to the print substrate;

developing a toner image on an imaging member;

transferring the toner image to the print substrate; and fixing the toner image to the print substrate.

21. An electrophotographic imaging apparatus, comprising:

an image forming unit for developing and transferring an image to a print substrate; and a plurality of substrate conditioning units comprising at least two rollers, situated before the image forming unit in a print substrate transport direction, wherein the at least two rollers are configured to compress the print substrate from about 70% to about 10% of the print substrate thickness;

at least one roller is configured to heat the print substrate; and a distance between at least two of the rollers conditioning the print substrate is about 30% to about 90% of a thickness of the print substrate.

22. The apparatus of claim 1, wherein a distance between at least two of the rollers conditioning the print substrate is about 50% to about 70% of a thickness of the print substrate.

* * * * *